United States Patent [19]

Giblin et al.

[11] Patent Number: 4,575,123

[45] Date of Patent: Mar. 11, 1986

[54] REPORT COVER

[75] Inventors: John P. Giblin, Mountain Lake, N.J.; Andrew E. Semancik, Joppa, Md.; Sherman D. Forehand, Trussville, Ala.

[73] Assignee: St. Regis Corporation, New York, N.Y.

[21] Appl. No.: 634,374

[22] Filed: Jul. 25, 1984

[51] Int. Cl.[4] ..... B42D 3/10; B42D 3/18; B42B 5/06

[52] U.S. Cl. ..... 281/48; 412/34

[58] Field of Search ..... 281/48, 15 R, 29; 412/34, 36, 37

[56] References Cited

U.S. PATENT DOCUMENTS 4,259,779 4/1981 Fulton, Jr. ..... 412/34 X

*Primary Examiner*—Paul A. Bell

*Attorney, Agent, or Firm*—Joseph M. Maquire

[57] ABSTRACT

A folded report cover is provided with a lock strip extending along at least one side of the cover parallel and contiguous to the fold and outwardly of the plane of the side. A channel-shaped gripping member is engaged to the cover along the fold and locked in place by a stop which extends from the interior of one leg of the gripping member into resilient engagement with a longitudinal edge of the lock strip and the one side of the cover. The other leg of the gripping member engages the opposite side of the cover. The lock strip is preferably an integral portion of the material of the cover.

8 Claims, 9 Drawing Figures

REPORT COVER

BACKGROUND OF THE INVENTION

This invention relates to a report cover and, more particularly, to an assembly for securely holding and covering papers.

Various kinds of folded covers are utilized to hold papers for business and school reports. In a folded report cover of a well-known type, papers comprising the report are placed between the two leafs of the cover with one of the longer edges of the papers arranged adjacent and parallel to the fold of the cover. An elongated plastic channel is slid onto the outside of the folded edge of the cover. The legs of the channel resiliently press and hold the opposing leafs of the cover and the enclosed papers together.

The channel can be readily removed by sliding it either parallel to or at an angle relative to the fold line. This ready removal capability, while convenient, often results in the inadvertent separation of the channel from the leafs of the cover particularly as the number of pages of the report increases. As a result, the enclosed papers may become soiled or disorganized.

Some report covers are provided with auxiliary binder clips or fasteners within the cover which pass through or otherwise more positively secure the papers to the leafs of the cover either directly or via an intermediate support which, in turn, is fixed to the cover, for example, by staples. The channel may, in any event, be retained to provide additional holding force or to improve the outer appearance of the report cover. The use of auxiliary components for holding the report papers can result in the need to locate the edges of the pages at a distance away from the folded edge. Accordingly, the overall width of the cover must be increased to provide proper coverage for papers of standard size.

The use of the additional clips, fasteners, supports, staples and the provision of additional cover area to properly accommodate the papers necessarily increases the overall cost of the report cover. Moreover, certain types of report documents may not have sufficient margins for providing holes for the passage of fasteners or it may otherwise be undesirable to form holes in the report pages in order to accommodate the fasteners.

SUMMARY OF THE INVENTION

The general object of the present invention is the provision of a report cover for holding papers possessing the virtues of simplicity, reliability, and low cost, and the ability to firmly grip the papers without the need to clip, staple or punch holes in the paper, with minimal effort required to add papers to or remove papers from the cover.

A folded report cover, made in accordance with the invention, includes a lock strip on at least one side of the cover extending parallel and contiguous to the fold and outwardly of the plane of the side of the cover. A channel-shaped gripping member is placed along the fold so as to surround the strip. The free end of one of the legs of the gripping member is provided with a stop which extends from the interior of the leg toward the direction of the other leg. The gripping member is adapted to firmly grip the cover and the papers by laterally sliding the gripping member onto the cover so that the stop engages a longitudinal edge of the strip and one side of the cover and the other leg engages the other side of the cover. The stop abuts against the lock strip to preclude an inadvertent lateral disengagement of the gripping member and the cover.

The lock strip is preferably an integral portion and extension of one side of the cover material which is inturned from the fold and adhesively secured onto the other side of the cover.

In an alternative embodiment of the invention, integral portions of the cover are inturned from a central fold and secured to the opposite sides of the cover to form dual lock strips. Each leg of the gripping member is provided, in that case, with a stop which juts out toward the other leg so that each of the stops engages a longitudinal edge of one of the strips and one of the sides of the cover.

BRIEF DESCRIPTION OF THE DRAWINGS

In the accompanying drawings, forming a part of the specification, and in which reference numerals shown in the drawings designate like or corresponding parts throughout the same.

DETAILED DESCRIPTION

FIGS. 1–4 illustrate a first embodiment of a report cover made in accordance with the invention.

Figure 1:
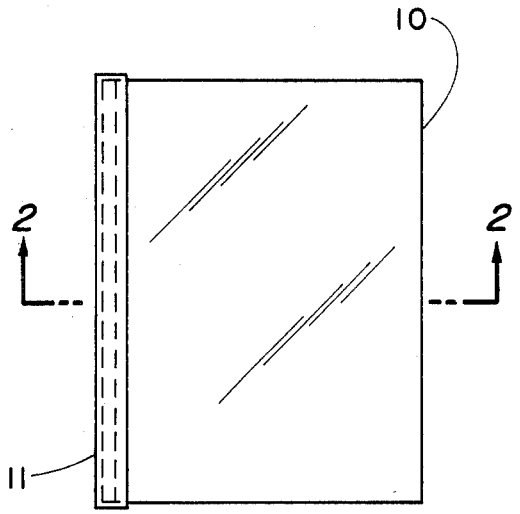
FIG. 1 is a plan showing a report cover and a channel-shaped gripping member.
Figure 2:
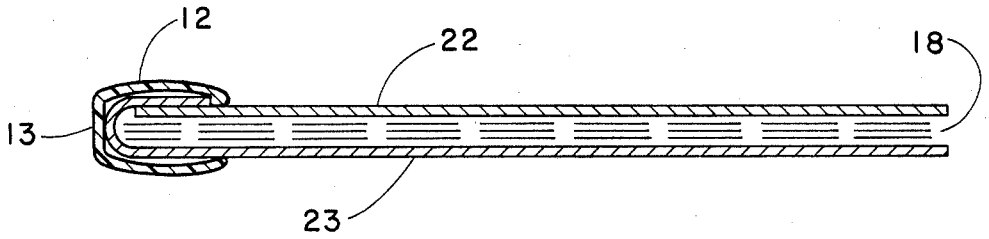
FIG. 2 is an enlarged sectional view of the report cover of FIG. 1 taken along view line 2—2.
Figure 4:
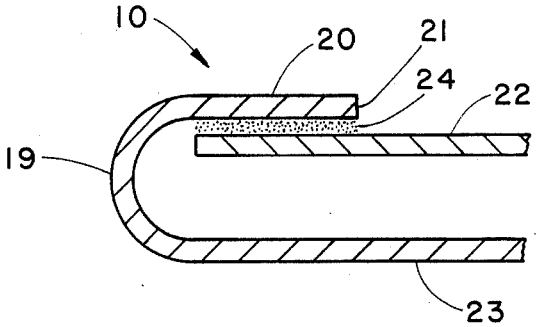
FIG. 4 is an enlarged detail of a portion of the cover of FIGS. 1 and 2.
Figure 3:
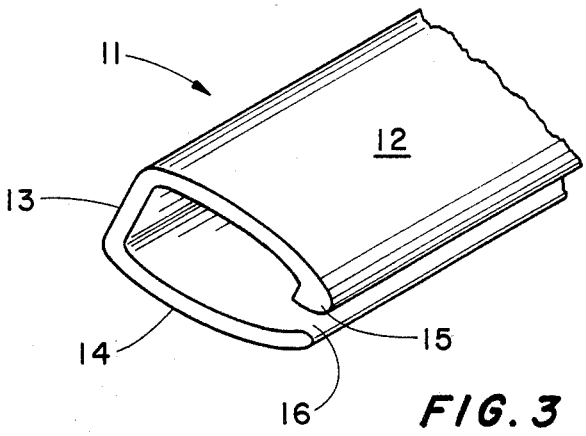
FIG. 3 is a partial perspective view of the channel-shaped gripping member of FIGS. 1 and 2.

A channel-shaped solid plastic slide or gripping member 11 extends along the entire length of a cover 10. As best shown in FIG. 3, the legs 12, 14 of the slide 11 extend from a web 13, in converging relation to each other at their free ends, to form a narrow opening 16 at the free ends of the legs. The interior of the free end of leg 12 is formed with a lip or stop 15 that juts out in the direction of leg 14.

The slide 11 is adapted to firmly grip the cover 10 and enclosed papers 18 by laterally sliding it along and/or across the fold of the cover so that stop 15 of leg 12 engages a longitudinal edge 21 of a lock strip 20 and exterior side 22 of the cover and leg 14 engages exterior side 23 of the cover. Web 13 preferably abuts fold line 19 of the cover when stop 15 is laterally engaged against longitudinal edge 21 of lock strip 20. The engagement of stop 15 and longitudinal edge 21 of lock strip 20 prevents a reverse movement of the slide 11 across the width of lock strip 20. Thus, slide 11 cannot be disengaged from the cover unless it is positively and intentionally slid parallel to its longitudinal axis. In the embodiment of FIGS. 1–4, lock strip 20 constitutes a longitudinal end of a first paper sheet, the lower leaf of the cover, that is inturned from the fold to overlie side 22 of the cover. Lock strip 20 is secured by an adhesive 24 to an independent sheet which constitutes side 22 of the cover. Strip 20 extends parallel and contiguous to the fold and outwardly of the plane of the exterior of side 22 of the cover. Side 22 may be made of a clear plastic sheet, for example, polypropylene, and side 23 may be composed of a paper material.

The physical characteristics of the material of slide 11 should be such as to permit resilient movement of legs 12 and 14 away from each other to accommodate the papers and the cover and yet provide a firm grip on the cover 10 and papers 18.

While a preferred slide material is extruded polystyrene, slide 11 may be composed of other plastics or made from other suitable materials, for example, spring steel.

Figure 5:
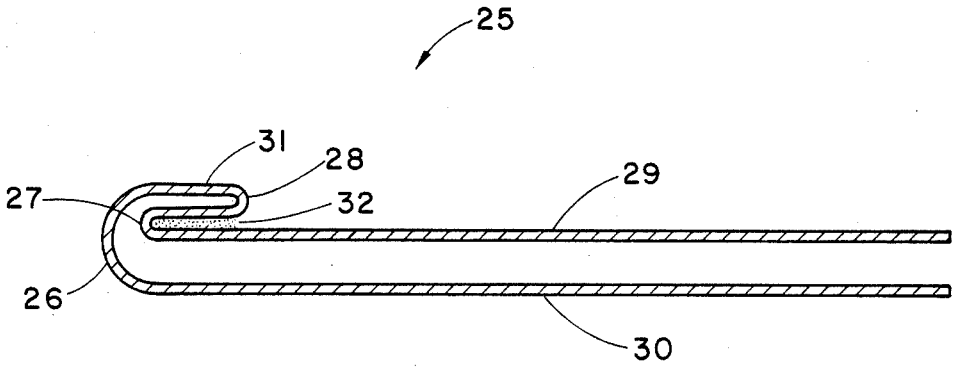
FIG. 5 is a sectional view of a report cover according to a second embodiment of the invention in which a portion of the cover is utilized to integrally form a lock strip.

In the alternative embodiment shown in FIG. 5, a cover 25 is composed of a single rectangular sheet of paper having an integral lock strip 31 and leafs or sides 29 and 30. Lock strip 31 is formed by inturning and folding a first folded edge 28 of the sheet onto the exterior of side 29 along fold lines 26, 27. The fold lines 26, 27 and 28 are parallel to each other. Lock strip 31 is adhesively secured at 32 to the exterior of side 29 of the cover.

Slide 11 may be engaged with cover 25 by laterally sliding it along the fold of the cover so that stop 15 engages fold line 28 and the exterior of side 29 of the cover and leg 14 engages the exterior of side 30 of the cover. Alternatively, the slide 11 can be engaged to the cover by laterally sliding it across lock strip 31 from fold line 26 toward fold line 28 until stop 15 extends beyond fold line 28 and engages side 29. Slide 11, however, can only be disengaged by a sliding movement along its longitudinal axis.

Figure 6:
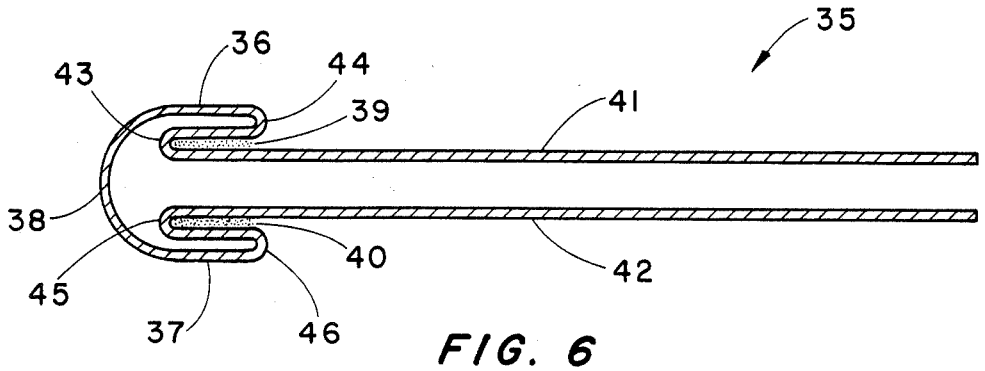
FIG. 6 is a sectional view of a report cover according to a third embodiment of the invention including two lock strips integrally formed from the cover material.

In the alternative embodiment of FIG. 6, cover 35 employs folds similar to that of FIG. 5 to provide lock strips 36 and 37 on opposite sides of a fold line 38 of the main folded edge of the cover. Lock strips 36, 37 are secured by adhesive 39, 40 to the leafs or sides 41, 42 of the cover 35. Sides 41, 42 are respectively folded along fold lines 43, 44 and 45, 46 which extend parallel to the folded edge of the cover defined by fold line 38.

Figure 7:
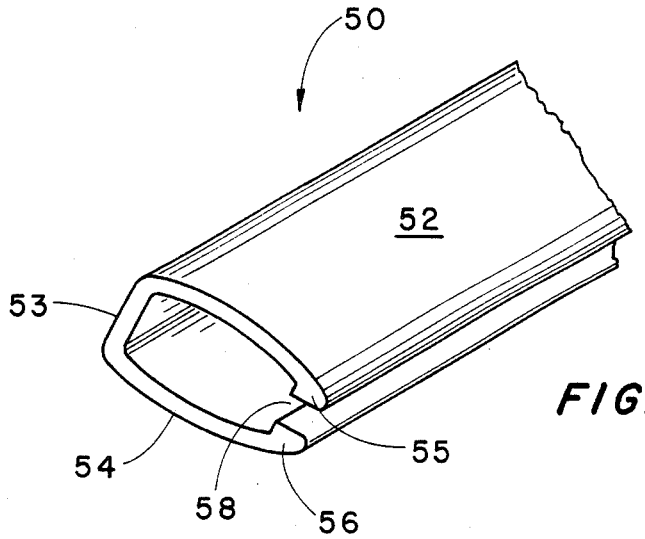
FIG. 7 is a partial perspective view of a channel-shaped gripping member designed to be engaged with the cover of FIG. 6.
Figure 8:
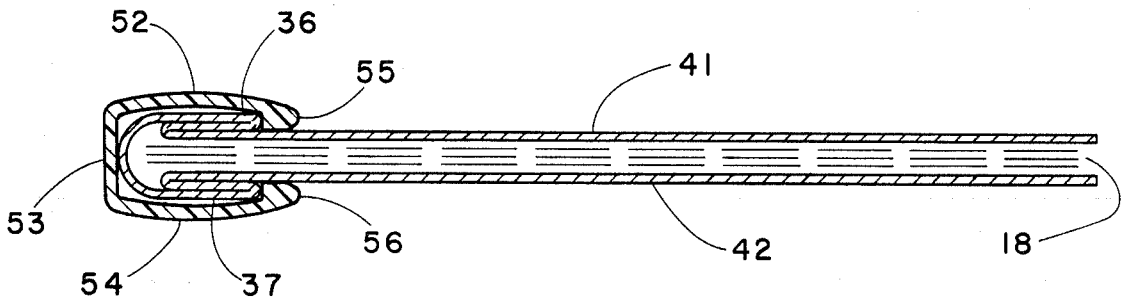
FIG. 8 is a sectional view illustrating the engagement of the cover and gripping member of FIGS. 6 and 7.

A modified channel-shaped slide or gripping member 50, as shown in FIGS. 7 and 8, is employed in connection with cover 35. The interior of each free end of legs 52, 54 of slide 50 is formed with a lip or stop 55, 56 that respectively juts out in the direction of the opposite leg. Legs 52, 54 extend from a web 53 of the slide in converging relation to each other to define a narrow opening 58. The slide 50 may be engaged to firmly grip the cover 35 and the enclosed papers 18 by laterally sliding it along and/or across the fold of cover 35 so that stop 55 engages the edge of lock strip 35 along fold line 44 and side 41 and stop 56 engages the edge of lock strip 37 along fold line 46 and side 42. Disengagement can be effected only by axially moving slide 50 parallel to fold lines 38, 44, 46.

Figure 9:
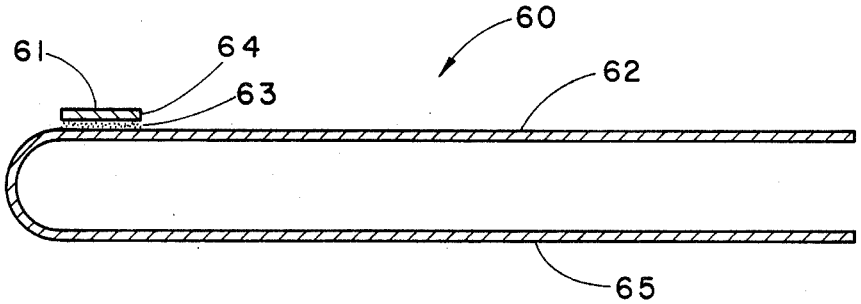
FIG. 9 is a sectional view of a cover according to a fourth embodiment of the invention.

FIG. 9 illustrates still another embodiment of the invention in which a cover 60, composed of a single rectangular sheet of paper or the like, is provided with non-integral, auxiliary longitudinal strip 61 secured to the exterior of one of the leafs or sides 62 of the cover. Strip 61 extends parallel and contiguous to the fold of the cover and outside of the plane of the side 62 of the cover to which it is secured by an adhesive 63 or by other suitable means. A slide 11, described herein, may be utilized to grip the cover 60 and enclosed papers by laterally sliding it onto the fold and the lock strip 61 so that stop 15 engages a longitudinal edge 64 of the lock strip 61 and side 62 and leg 14 engages side 65 of the cover. Cover 60 may be modified by adhesively securing a lock strip, similar to lock strip 61, to the opposite side 65 of the cover and utilizing the slide 50, described herein, to secure the cover and the enclosed papers. Those skilled in the art will appreciate that a combination of an auxiliary lock strip and integral lock strip may also be utilized without departing from the spirit of the invention encompassed in the claims.

Although the invention has been described with reference to providing the lock strip and slide along the side of a report cover, it will be evident that this structure can be placed at the top of the cover to provide a so-called flip-top version, i.e., a cover folded and engaged along its upper edge.

We claim:

1. A report cover comprising a folded cover adapted to hold papers each having one edge extending parallel and contiguous to the fold in the cover, a strip secured to one of the exterior sides of the cover and extending parallel and contiguous to the fold in the cover, a channel-shaped gripping member extending along the fold and having the interior of the free end of one of its legs formed with a stop that juts out in the direction of the other leg, the gripping member being adapted to firmly grip the cover and the papers by laterally sliding the gripping member onto the cover so that the stop of the one leg interlocks with a longitudinal edge of the strip and the one side of the cover to prevent motion of the gripping member toward and perpendicular to the longitudinal edge of the strip and the other leg engages the other side of the cover.

2. A report cover as defined in claim 1 wherein the strip is an integral portion of the cover.

3. A report cover as defined in claim 1 wherein the gripping member is made of polystyrene.

4. A report cover as defined in claim 1 wherein the strip is an extension beyond the fold line of the other side of the cover and overlaps and is secured to the one side of the cover.

5. A report cover as defined in claim 1 wherein the strip is formed by folding both sides of the cover against one of the sides along a line extending parallel to and adjacent to said fold.

6. A report cover as defined in claim 5 wherein the folded cover is a single sheet.

7. A report cover as defined in claim 1 further comprising a second strip secured to the other of the exterior sides of the cover and extending parallel and contiguous to the fold in the cover, and wherein the gripping member has the interior of the free end of its other leg formed with a stop that juts out in the direction of the one leg, the gripping member being adapted to firmly grip the cover and the papers by laterally sliding the member onto the cover so that each of the stops engages a longitudinal edge of one of the strips and one of the sides of the cover.

8. A report cover as defined in claim 7 wherein the folded cover is a single sheet.

* * * * *

REEXAMINATION CERTIFICATE (763rd)

United States Patent [19] [11] B1 4,575,123

Giblin et al. [45] Certificate Issued Sep. 29, 1987

[54] REPORT COVER

[75] Inventors: John P. Giblin, Mountain Lake, N.J.; Andrew E. Semancik, Joppa, Md.; Sherman D. Forehand, Trussville, Ala.

[73] Assignee: Champion International, Stamford, Conn.

Reexamination Request:
No. 90/001,114, Oct. 10, 1986

Reexamination Certificate for:

| | |
|---|---|
| Patent No.: | **4,575,123** |
| Issued: | **Mar. 11, 1986** |
| Appl. No.: | **634,374** |
| Filed: | **Jul. 25, 1984** |

[51] Int. Cl.[4] ..... B42D 3/10; B42D 3/18; B42B 5/06

[52] U.S. Cl. ..... 281/48; 412/34

[58] Field of Search ..... 281/15 R, 29, 48; 412/34, 36, 37

[56] References Cited

U.S. PATENT DOCUMENTS 4,486,032 12/1984 Leahy ..... 281/46

*Primary Examiner*—Paul A. Bell

[57] ABSTRACT

A folded report cover is provided with a lock strip extending along at least one side of the cover parallel and contiguous to the fold and outwardly of the plane of the side. A channel-shaped gripping member is engaged to the cover along the fold and locked in place by a stop which extends from the interior of one leg of the gripping member into resilient engagement with a longitudinal edge of the lock strip and the one side of the cover. The other leg of the gripping member engages the opposite side of the cover. The lock strip is preferably an integral portion of the material of the cover.

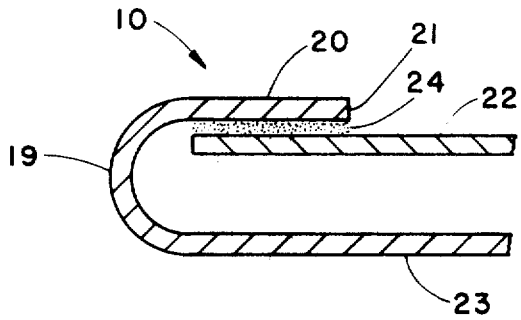

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 4, 5, 7 and 8 are cancelled.

Claims 1 and 6 are determined to be patentable as amended.

Claim 3, dependent on an amended claim, is determined to be patentable.

1. A report cover comprising a folded cover adapted to hold papers each having one edge extending parallel and contiguous to the fold in the cover, a strip secured to one of the exterior sides of the cover and extending parallel and contiguous to the fold in the cover, *said strip being an extension beyond the fold line of the other side of the cover and overlapping and being secured to the one side of the cover,* a channel-shaped gripping member extending along the fold and having the interior of the free end of one of its legs formed with a stop that juts out in the direction of the other leg, the gripping member being adapted to firmly grip the cover and the papers by laterally sliding the gripping member onto the cover so that the stop of the one leg interlocks with a longitudinal edge of the strip and the one side of the cover to prevent motion of the gripping member toward and perpendicular to the longitudinal edge of the strip and the other leg engages the other side of the cover.

6. A report cover as defined in claim [5] *1* wherein the folded cover is a single sheet.

* * * * *